United States Patent [19]

Lemaire

[11] Patent Number: 4,858,320

[45] Date of Patent: Aug. 22, 1989

[54] WEDGE LOCK FOR POCKET KNIFE BLADE

[76] Inventor: Denis J. Lemaire, 534, de la Verendrye, Boucherville, Quebec, Canada, J4B 2Y1

[21] Appl. No.: 148,918

[22] Filed: Apr. 4, 1988

[51] Int. Cl.[4] ..... B26B 1/08

[52] U.S. Cl. ..... 30/162; 30/163

[58] Field of Search ..... 30/160–163

[56] References Cited

U.S. PATENT DOCUMENTS 4,006,514 2/1977 Penman ..... 30/161

*Primary Examiner*—Douglas D. Watts

[57] ABSTRACT

A wedge-shaped arrangement for retracting a leaf spring is positioned in abutment against the tang of a cutting knife. The retraction of the leaf spring is produced by a sliding rod which engages the wedge and pulls on the leaf spring.

8 Claims, 3 Drawing Sheets

WEDGE LOCK FOR POCKET KNIFE BLADE

BACKGROUND OF THE INVENTION

1. Field of the Invention

The present invention is directed to a lock for barring a pocket knife blade and more particularly to a wedge arrangement for locking and unlocking the blade from its protracted position.

2. Prior Art

A search of the prior art has revealed U.S. Pat. Nos. 2,826,813 and 4,354,313. However, no wedge arrangement has been found for locking and unlocking of the type hereinafter disclosed a pocket knife blade.

SUMMARY OF THE INVENTION

According to the present invention, it is possible to open and close the blade of a pocket knife with one hand. There is also no need to touch the blade. The wedge arrangement proposed for locking the blade allows the pocket knife to remain thin and compact. Some governments make it illegal to have a pocket knife wherein the blade opens automatically, by gravity or by inertia. Although the present device is easy to operate, it is completely legal in this regard.

The lock for barring a cutting blade of a pocket knife comprises a leaf spring which is adapted to abut at one end with the tang of the blade to maintain the latter in its protracted position. The plane of the leaf spring is retracted from the plane of the blade by a wedge arrangement which consequently allows the blade to be retracted in its closed position.

DETAILED DESCRIPTION OF THE DRAWING

Figure 1:
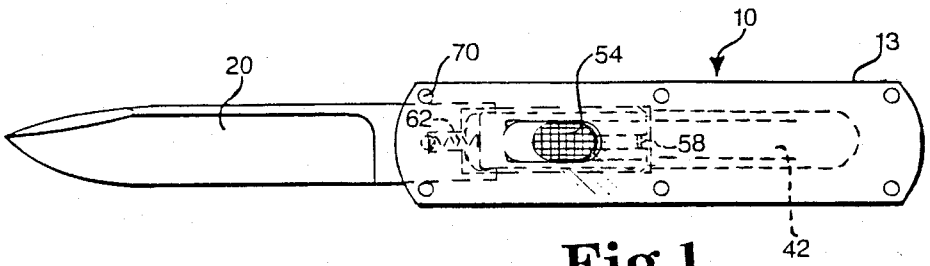
FIG. 1 is a plan view of a pocket knife according to the invention with the blade in its protracted position.

Referring to FIGS. 1 to 5, reference character 10 generally indicates a blade-knife having a wedge type lock 12 and comprising an elongated casing 13 formed by an upper face plate 14 and a lower face plate 16 and a retractable blade 20.

Figure 3:
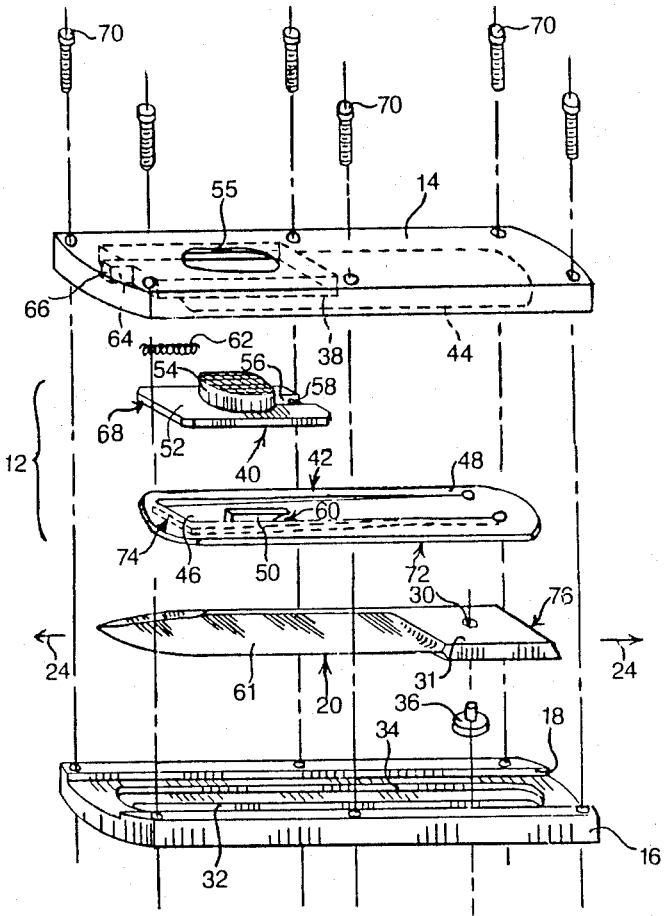
FIG. 3 is an exploded view of the knife shown in FIG. 2.

The lower face 16 is provided with a groove 18 which serves as guiding means for the sliding movement of blade 20 indicated in FIG. 3 by arrows 24.

This sliding movement of the blade 20 is produced by pressure exerted on a button 26 by the user's finger. The pressure is transmitted to blade 20 by means of a screw type component 28 which is threadedly inserted in aperture 30 in the tang 31 and slides inside groove 32 provided in the lower face plate 16.

An elongated recess 34 in the face plate 16 34 is used to guide the sliding action of a stabilizing element 36 slidingly mounted on screw 28.

Figure 2:
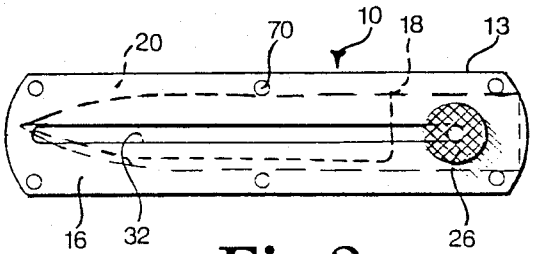
FIG. 2 is a plan view of the side opposite the one shown in FIG. 1 with the blade in its retracted position.

The stabilizing element 36 is used to reduce the stress concentration between the screw 28 and the extremities of the groove 32 when the blade is pushed at both outermost positions as shown in FIGS. 1 and 2. Element 36 also stabilizes the upright position of the screw type component 28. The stress concentration reducing effect is imputable to the larger radius of material of the element 36 on which the force is applied around the recess 34.

The upper face plate 14 is provided with a groove 38 adapted to guide the sliding action of a lifting component 40. A leaf spring 42 is also inserted in the face place 14 inside a groove 44.

Leaf spring 42 is used in conjonction with lifting component 40 to provide releasable locking action on blade 20. Leaf spring 42 consists of a piece of resilient material which has a centrally punched longitudinal tongue 46 surrounded by a contour plate 48. The tongue is bent relative to the contour plate 48 at an angle which allows the tip 74 of the tongue 46 to exceed outside the plane of the plate 48. A wedge shaped component 50 is rigidly secured to the top of the tongue 46.

Lifting component 40 comprises a base plate 52 to which is rigidly attached a knob 54 which extends through aperture 55 provided in the upper face plate 14. Base plate 52 is U-shaped in order to provide a spacing 56 adapted to receive the wedge-shaped component 50. A small rod 58 extends transversally from the longitudinal sides of spacing 56.

Figure 4:
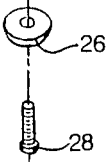
FIG. 4 is a cross-sectional view of the wedge action with the tongue of a leaf spring in a released position.
Figure 4:
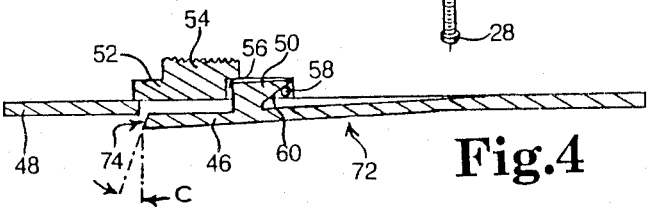
Figure 5:
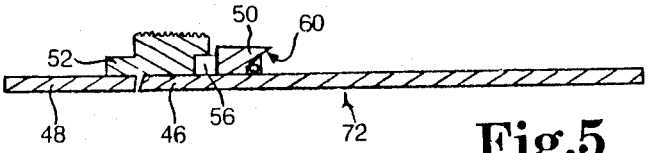
FIG. 5 is a cross-sectional view of the wedge action as shown in FIG. 4 with the tongue in a retracted position.

Rod 58 is used in conjonction with the wedge-shaped component 50 to lift the tongue 46 so as to make tongue 46 coplanar with the contour plate 48 as illustrated in FIG. 5. When the sliding of the lifting component 40 is produced by a pressure of the user's thumb on knob 54, rod 58 which is rigidly attached to base 52 slides against inclined surface 60 of wedge-shaped component 50, therefore lifting tongue 46 as illustrated in FIGS. 4 and 5. The inclined surface 60 defines an acute angular space between the tongue 46 and the wedge-shaped component 50.

The top surface of the knob 54 is preferably slightly inclined and provided with grooves which make the surface rugose in order to facilitate transformation of the pressure applied by the thumb of the user into sliding motion of lifting component 40 in groove 38.

An helicoidal spring 62 or another suitable device is positioned inside an extension 64 of groove 38. One extremity of spring 62 rests against surface 66 of the extension 64 while the other end rests against surface 68 of the component 40 so that the spring is compressed when rod 58 slides along surface 60 and bounces back when pressure by the user's thumb is released from the knob 54. The upper face plate 14 and lower face plate 16 forming the outer elongated casing 13 are held together by screw-type components 70.

The blade 20 is protracted out of casing 13 by applying pressure on knob 26 which slides the blade in groove 18.

Once the cutting edge portion 61 of the blade is fully protracted out, no more pressure is applied, by the blade 20, on back surface 72 of the tongue 46 which automatically assumes its released position illustrated in FIG. 4.

In that released position, front surface 74 of leaf spring 46 is directly in contact with back surface 76 of tang 31 therefore inhibiting retraction of the blade inside casing 13 and accordingly barring the blade.

To retract blade 20 inside casing 13, the user's thumb applies pressure in the direction of the pointed end of the blade on knob 54 of lifting component 40 which as stated previously will lift tongue 46 until it becomes coplanar with the contour plate 48. The user's index can then apply pressure on button 26 and retract the blade 20.

To avoid jamming of tongue 46 while initiating the retraction of the blade or a full protraction of it, both surfaces 74 and 76 are preferably chamfered on opposite sides at an angle C of about 3° to 5°.

In this embodiment, it is particularly easy to retract the blade inside its casing with one hand. Because the knob 54 and the button 26 are located at remote distances and on opposite sides of the knife, it is possible to simultaneously slide them in opposite direction with the thumb and the index of the same hand.

FIGS. 6 to 9 illustrate another embodiment of the invention again using a wedge-type lock adapted for a knife having a blade which protracts from the handle by a pivoting action rather than a sliding action as was the case with the previously described embodiment.

In this embodiment of the invention, a rod 82 forming part of a lifting component 84 is rigidly attached to the side of the component 84 which slides in a groove 88 provided in a superposed casing 90.

Figures 6, 7, 8, 9:
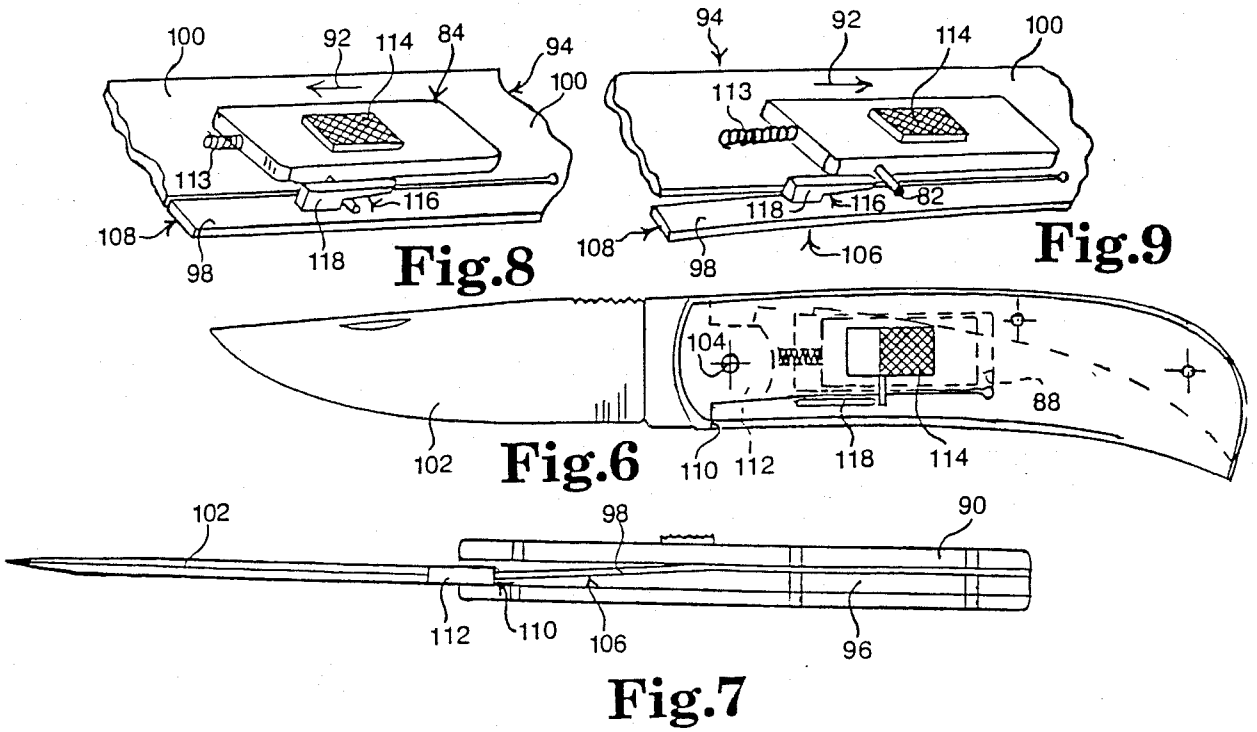
FIG. 6 is a plan view of the pocket knife according to another embodiment of the invention with the blade in its protracted position.
FIG. 7 is a bottom view of the knife shown in FIG. 6 and, FIGS. 8 and 9 are detailed views of the lock mechanism according to the embodiment shown in FIG. 6.

The sliding of the lifting component 84 is indicated in FIGS. 8 and 9 by an arrow 92.

A leaf spring 94 is located like face plate or a bolster lining against the upper face of the casing 90 and over the cavity 96 designed to receive the retracted blade 102.

The leaf spring 94 is made of a piece of resilient material from which a lateral tongue 98 is longitudinally punched. The tongue 98 projects away from the plane of the main strip 100 of leaf spring 94 by an angle sufficient to displace the tip surface 108 of the tongue 98 below and adjacent the plane of the main strip 100 of the spring 94.

In use, when blade 102 is protracted by a pivoting action around a hinge 104, tip surface 108 of the tongue 98 abuts against the end surface 110 of tang 112 and accordingly the pivoting of the blade 102 is barred.

To allow the pivotal retraction of blade 102 inside the casing 90, the user must apply pressure on the knob 114 of lifting component 84 in order to induce a sliding movement which will cause rod 82 to slide against inner surface 116 of wedge-shaped component 118. The wedge-shaped component 118 being rigidly attached to the tongue 98, the latter is pulled by the rod 82 so that it reaches the same plane as the one of the main strip 100 as in FIG. 8. Once the tongue 98 is coplanar with strip 100, end surfaces 108 and 110 are no longer in contact and the blade 102 is free to rotate around the hinge 104.

When pressure is released from the knob 114, a small helicoidal spring 113 brings the lifting component 84 to its original position such as shown in FIG. 9.

The wedge action takes place along the lateral portion of the leaf spring 94 in FIGS. 6–9 while it is centrally located in FIGS. 1–5.

Figure 10:
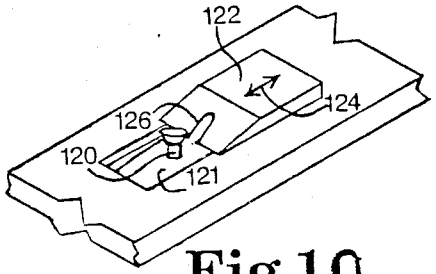
FIG. 10 is a perspective view of another embodiment of a wedge action lock.

It is within the embodiment of this invention to substitute other wedge type action locks for the ones described above. FIG. 10 illustrates an alternative to the wedge type lock 12 wherein a nail type component 120 fixed to a leaf spring 121 can be lifted by a split wedge plate 122 which corresponds to the lifting component 40. When the wedge plate 122 slides in the direction of the arrow 124, the U-shaped notch 126 engages the nail type component and raises the leaf spring 121.

I claim:

1. A lock for barring and unbarring a cutting blade of a pocket knife, the said blade having a cutting edge portion and a tang in a flat plane, the said lock comprising a substantially flat leaf spring extending in a plane substantially parallel to said blade, said leaf spring having one end slightly bent away from said parallel plane so as to abut against the tang of said blade for maintaining the cutting blade in its forwardly projected direction, wedge means for retracting the said one end of the leaf spring into said parallel plane so as to bring said one end of said leaf spring away from the flat plane of said tang and allow freedom of movement of said blade.

2. A lock for a cutting blade as recited in claim 1, wherein said leaf spring is partly split in two longitudinal strips, one of said strips being curved so that the end of said one strip abut against the tang of the blade in a plane different than the plane of the other strip, a wedge member secured to said one strip and defining an acute angular space between said one strip and said wedge member, a sliding member mounted on the other stip and adapted to longitudinally moves relative to said one strip, the said sliding member comprising a rod member secured to said sliding member, said rod member being mounted on said sliding member so as to slide in said angular space and apply pressure on said wedge member for changing the curve of said one strip and for removing the end of said one strip from abutting the tang of the blade.

3. A lock for a cutting blade as recited in claim 2, wherein the said sliding member is resiliently bias in a direction to retract said rod member from of said angular space.

4. A lock for a cutting blade as recited in claim 3, wherein the two strips are mounted side by side in about the same plane and longitudinally fixed relative to each other.

5. A pocket knife comprising a pair of bolster linings superposedly fixed to each other and defining a space therebetween, a cutting blade slidably mounted in said space relative to one of said lining and adjacent thereto, a leaf spring fixed to the other lining in said space, one end of said leaf spring adapted to abut against the end of said blade when the latter is projecting partly out of said linings, a wedge member secured to said leaf spring, the said wedge member defining an acute angular recess between said leaf spring and said wedge member, a sliding member mounted in a slot provided in said other lining and adapted to longitudinally move relative to said wedge member, the said sliding member comprising a rod member adapted to slide in said angular recess so as to pull on said leaf spring and retract latter from abutment with the end of the blade, spring means for resiliently pushing said rod member out of said angular recess.

6. A pocket knife as recited in claim 5, comprising a first knob connected to said end of said blade and extending out of a slot provided through said first lining, said sliding member exceeding out of the slot in said other lining and at the distal end from said end of said blade when said blade in its retracted position, wherein a movement of the said knob and said sliding member simultaneously projects the blade out of the linings and causes the said abutment with the spring leaf.

7. A lock for a cutting blade as recited in claim 1, comprising a shank secured to said leaf spring and an enlarged head at the end of said shank, an intermediate lining located adjacent said leaf spring, a wedged plate slidingly mounted on said intermediate lining, said wedged plate having a slot adapted to engage said shank and pull on said leaf and said leaf spring during its sliding movement for freeing the tang of said blade.

8. A knife having a retractable blade comprising, an elongated casing having an upper and a lower face plate and a longitudinal space between the two face plates a cutting blade extending in said space, guide means on said lower face plate extending through a slot provided in said lower face plate and secured to one end of said blade, said guide means adapted to slide said blade in said space and to project part of it outside the casing to an outermost position, a locking blade located in said space and disposed over said cutting blade, one end of said locking blade adapted to abut against the end of the cutting blade when the latter is slidden at said outermost position a wedge shaped member fixed to said locking blade, a lifting component slidingly mounted in said upper face plate, said lifting component having a rod adapted to engage said wedge shaped member and pulled on said locking blade, whereby said one end of the locking blade is removed from abutting the said end of the cutting blade.

* * * * *